US005912097A

United States Patent [19]

Aslam et al.

[11] Patent Number: 5,912,097

[45] Date of Patent: Jun. 15, 1999

[54] ELECTROSTATOGRAPHIC METHOD USING AN OVERLAY TONER

[75] Inventors: Muhammad Aslam; Lawrence Paul Demejo, both of Rochester; Dinesh Tyagi, Fairport, all of N.Y.

[73] Assignee: Eastman Kodak Company, Rochester, N.Y.

[21] Appl. No.: 08/088,012

[22] Filed: Jul. 6, 1993

[51] Int. Cl.[6] ..... G03G 13/01

[52] U.S. Cl. ..... 430/47; 430/42; 430/44; 430/54

[58] Field of Search ..... 430/47, 42, 44, 430/54

[56] References Cited

U.S. PATENT DOCUMENTS

| | | | |
|---|---|---|---|
| Re. 25,136 | 3/1962 | Carlson | 430/109 |
| 2,618,552 | 11/1952 | Wise | 430/107 |
| 2,638,416 | 5/1953 | Walkup et al. | 430/111 |
| 2,659,670 | 11/1953 | Copley | 430/120 |
| 2,788,288 | 4/1957 | Rheinfrank et al. | 430/107 |
| 2,917,460 | 12/1959 | Solar | 430/109 |
| 3,694,359 | 9/1972 | Merrill et al. | 430/109 |
| 3,809,554 | 5/1974 | Merrill et al. | 430/109 |
| 3,813,267 | 5/1974 | Honjo et al. | 430/99 |
| 3,873,325 | 3/1975 | Westdale | 430/98 |
| 3,945,726 | 3/1976 | Ito et al. | 430/99 |
| 4,027,048 | 5/1977 | Crystal | 427/14 |
| 4,064,285 | 12/1977 | Mammino | 427/24 |
| 4,066,802 | 1/1978 | Clemens | 427/24 |
| 4,216,283 | 8/1980 | Cooper et al. | 430/126 |
| 4,407,922 | 10/1983 | Grushkin et al. | 430/98 |
| 4,464,453 | 8/1984 | Cooper et al. | 430/126 |
| 4,557,991 | 12/1985 | Takagiwa et al. | 430/109 |
| 4,581,312 | 4/1986 | Nakahara et al. | 430/101 |
| 4,654,282 | 3/1987 | Ng et al. | 430/54 |
| 4,666,804 | 5/1987 | Haneda et al. | 430/45 |
| 4,686,163 | 8/1987 | Ng et al. | 430/47 |
| 4,758,491 | 7/1988 | Alexandrovich et al. | 430/110 |
| 4,758,506 | 7/1988 | Lok et al. | 430/106.6 |
| 4,814,253 | 3/1989 | Gruber et al. | 430/106.6 |
| 4,868,075 | 9/1989 | Gilgore | 430/45 |
| 4,927,727 | 5/1990 | Rimai et al. | 430/99 |
| 4,986,211 | 1/1991 | Coulter, Jr. et al. | 430/40 |
| 5,021,318 | 6/1991 | Mayo et al. | 430/124 |
| 5,023,038 | 6/1991 | Aslam et al. | 430/99 |
| 5,045,888 | 9/1991 | Imaeda | 355/282 |
| 5,049,646 | 9/1991 | Tyagi et al. | 528/272 |
| 5,079,115 | 1/1992 | Takashima et al. | 430/45 |
| 5,085,962 | 2/1992 | Aslam et al. | 430/99 |
| 5,089,547 | 2/1992 | McCabe et al. | 524/262 |
| 5,118,588 | 6/1992 | Nair et al. | 430/110 |
| 5,234,783 | 8/1993 | Ng | 430/45 |
| 5,254,426 | 10/1993 | Aslam et al. | 430/42 |

FOREIGN PATENT DOCUMENTS

| | | |
|---|---|---|
| 91586/82 | 6/1983 | Australia . |
| 91450/82 | 7/1983 | Australia . |
| 91451/82 | 7/1983 | Australia . |
| 989683 | 5/1976 | Canada . |
| 31 48 505 | 6/1983 | Germany . |
| 55-151647 | 11/1980 | Japan . |
| 57-032447 | 2/1982 | Japan . |
| 57-176060 | 10/1982 | Japan . |
| 48-82007 | 6/1984 | Japan . |
| 84-025214 | 6/1984 | Japan . |
| 59-147044 | 8/1984 | Japan . |
| 62-294423 | 11/1987 | Japan . |
| 90-120765 | 5/1990 | Japan . |
| 1553301 | 9/1979 | United Kingdom . |
| 2 075 703 | 11/1981 | United Kingdom . |

OTHER PUBLICATIONS

Color Prints with Uniform Gloss, Xerox Disclosure Journal, vol. 16, No. 1, Jan./Feb. '91.

*Primary Examiner*—Maria Nuzzolillo
*Assistant Examiner*—Laura Werner
*Attorney, Agent, or Firm*—Anne B. Kiernan; Doreen M. Wells

[57] ABSTRACT

A method is provided for increasing the release temperature from the fuser in copying and printing processes comprising the steps of forming a toner layer on a receiver with an imagewise overlay toner on top and fixing the layers of toner by contact with a fuser.

20 Claims, 2 Drawing Sheets

ELECTROSTATOGRAPHIC METHOD USING AN OVERLAY TONER

TECHNICAL FIELD

This invention relates to a method of fusing toner in an electrostatographic machine. In particular, it relates to a method which allows for increasing the release temperature of a receiver from a fuser in copying and printing processes.

BACKGROUND ART

In a conventional electrostatographic copying or printing process, an electrostatic image is formed on an image member, and toned with charged toner particles. The toner image is then transferred to a receiver and fixed to the receiver by a suitable method, such as by pressurized contact with a heated fuser. One of the variables effecting the speed at which toner images can be produced in an electrostatographic machine is the temperature of the fuser. Generally, the hotter the fuser the faster the toner images on the receiver can be fused. However, the hotter the fuser, the greater the chances that toner will stick to or offset onto the fuser. To prevent the toner particles on the receiver from offsetting onto the fuser, depending on the toner, a lower fusing temperature can be used in a belt or roller fuser, and/or a longer belt can be used in a belt fuser. Alternatively, if the temperature of the fuser must be maintained to properly fuse the toner, the fuser can be coated with a release aid, usually silicone oil. However, silicone oil tends to affect the gloss of the toner on the receiver. It is also difficult to control the amount of silicone oil on the fuser. If too little oil is applied, toner will offset onto the fuser. If too much oil is applied, the presence of oil on the receiver will cause visible differences in the gloss of the final toner image. In addition, some silicone oil vaporizes during fusing and contaminates the subsystems of electrostatographic machines with a particularly negative impact on photoconductive image members (photoconductors) and the corona charger wires.

There are a few approaches disclosed in the background art to prevent toner offset onto the fuser without using silicone oil. One approach is to add release additives to the toner as disclosed, for example, in U.S. Pat. Nos. 4,814,253 and 4,758,506. The addition of release additives to the toner composition can create a problem, however, because release additives not only prevent the toner particles from sticking to the fuser, but they may also prevent the toner particles from sticking to each other and to the receiver, thereby reducing transfer efficiency. This is a particular problem when several layers of toner are transferred over one another, because the release additives in lower toner layers hinder the adhesion of upper toner layers. In addition, some release additives such as silicones, adipates and azealates added to each toner in a multilayer toner image can cumulatively act as plasticizers, that is, they lower the glass transition temperature of the toner binders which causes the toners of the final toner image to be stickier and more likely to stick to or offset onto surfaces a final toner image contacts when it is stacked or stored.

Another approach used to prevent toner offset onto the fuser mechanism is disclosed in Japanese Patent Application No. 48-82007, titled "Color Electrophotographic Process". The method involves the application of a transparent toner non-imagewise to the entire surface of the photoconductor prior to exposing and developing a color toner image on the photoconductor, and then transferring both the color and transparent toners to a receiver. Although the transparent toner may prevent the color toner from offsetting to the fuser, the application of the transparent toner to the entire surface of the photoconductor prior to the formation and development of an electrostatic image on the photoconductor creates several problems. For example, the excessive quantity of toner on the photoconductor makes it more difficult to achieve complete transfer of the toner from the photoconductor to the receiver. Because transfer is so difficult, much toner will remain on the photoconductor, which makes cleaning the photoconductor more difficult. Therefore, the cleaning system must be designed to handle the excess toner loads or the toner will cause a deterioration in the copy quality and shorten the life of the photoconductor. The application and cleaning of such large quantities of toner and increased wear on machine parts make this process expensive. Lastly, because the entire receiver is coated with the transparent toner, the entire surface of the receiver will have the same gloss, which may not be desirable.

Another method to prevent toner offset onto a fuser is the subject of U.S. Pat. No. 3,945,726, titled, "Electrophotographic Fixing Device". This patent discloses a device which applies an "image-separating agents" onto the leading edge of a receiver just prior to contact between the receiver and the fuser rollers. The application of "image-separating agents" by the patented device is disadvantageous, because it only prevents toner offset at the leading edge of the receiver, it may provide uneven gloss on the final toner image, and it does not prevent toner offset if the release temperature from the fuser is increased.

Australian Patent Au-B-91586/82, titled "Application of Protective Coating on a Toner Image" discloses a method for applying an imagewise "protective light-transmitting coating on a toner image", claim 1, to improve the adhesion of the toner to a substrate, because "different types of toner . . . adhere more poorly to the recepient surface than conventional ink." page 1.

It would be desireable to provide a process which allows for an increased release temperature of the toner-bearing receiver from a fuser while preventing toner offset onto the fuser.

SUMMARY OF THE INVENTION

The present invention meets the objective of providing a method for increasing the release temperature of a fuser while avoiding toner offset onto the fuser and overcoming the disadvantages of the background art processes by applying an overlay toner imagewise on top of an underlay toner image. The underlay toner image can be a single toner image or a multiple toner image in registation.

The invention, in its broader aspects, provides an image forming method in an electrostatographic apparatus having a fuser which has the following steps. A composite toner image is formed on a receiver. The composite toner image has an underlay toner image, comprising underlay toner, and an overlay toner image, comprising overlay toner. The overlay toner image is disposed imagewise on top of the underlay toner image. The underlay toner is adhesive to the fuser at a release temperature. The overlay toner is non-adhesive to the fuser at the release temperature. The composite toner image is fixed on the receiver by contacting the composite toner image on the receiver with the fuser. The composite toner image on the receiver is released from the fuser at the release temperature.

BRIEF DESCRIPTION OF THE DRAWINGS

In the detailed description of the preferred embodiment of the invention presented below, reference is made to the drawings, in which.

DESCRIPTION OF PARTICULAR EMBODIMENTS

Figure 1:
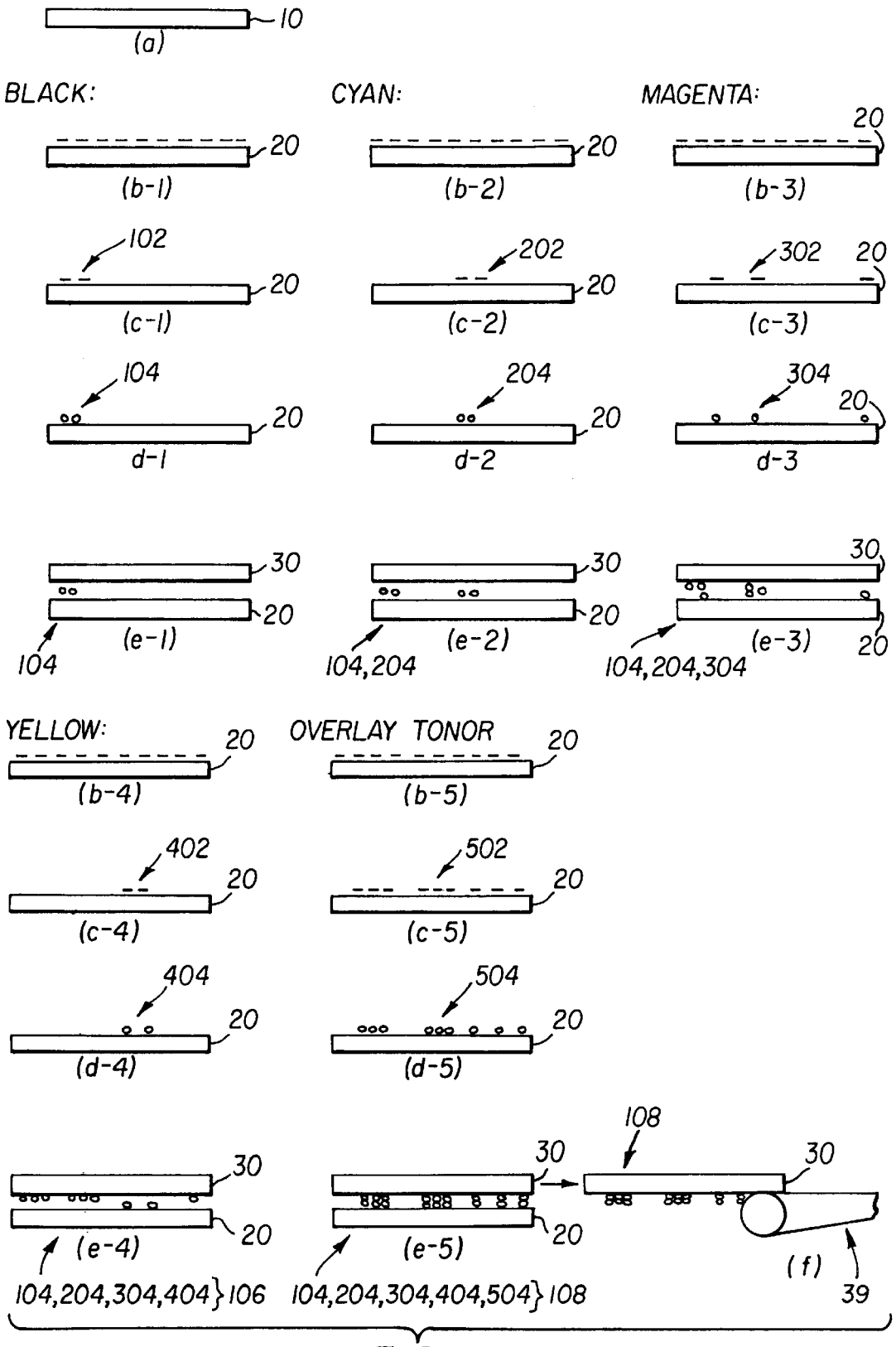
FIG. 1 is a diagrammatical view of a process for making a multicolor toner image with an overlay toner applied according to the process of the invention as depicted in a series of steps designated from (a) to (f).

In the method of the invention a composite toner image comprising an overlay toner image, comprised of overlay toner and an underlay toner image, comprised of overlay toner, is formed on a receiver, then fixed to the receiver in a fuser. The toners of the composite toner image are fused to the receiver by pressurized contact of the composite toner image on the receiver with one or more fuser members of a fuser at temperatures at which the overlay and underlay toners adhere to the receiver. The temperature of the receiver at which the toner-bearing receiver releases from the fuser is referred to herein as the release temperature. The release temperature of the fuser is selected from a range of temperatures within which the overlay toner is non-adhesive to the fuser, but the underlay toner is adhesive and at least a portion of the underlay toner would offset onto the fuser if the overlay toner were not present.

The toner used for underlay toner images, also referred to as color toner, can be any color toner including, but not limited to, black, cyan, magenta, yellow and clear. The overlay toner can also be any color toner, although the most preferred overlay toner is clear. The underlay toner image can comprise one or more toner images, in registration. For example, an electrostatic image is created for each color toner and an additional electrostatic image for the overlay toner of a desired final toner image. For a single-color final toner image the electrostatic image for the areas to be toned with the overlay toner can match the electrostatic image created for the areas to be toned with the color toner. For the multicolor final toner image, the electrostatic image of the areas to be toned with the overlay toner will be derived from a combination of the electrostatic images of the areas to be toned with the color toners.

The electrostatic image for the overlay toner can be derived in various ways from a single electrostatic image for a single color toner in a final toner image or from the combination of electrostatic images for more than one color toner in a final toner image. For example, the electrostatic image for the overlay toner can be exposed to form areas of uniform potential to provide a uniform top layer of overlay toner in the areas where color toner(s) of any density is (are) applied. Alternatively, the electrostatic image for the overlay toner can be exposed to form areas of nonuniform potential to provide a top layer of overlay toner which is proportional to the density of color toner(s) over which the overlay toner is applied. The formation of the latter electrostatic image for the application of overlay toner of nonuniform density may be desirable, because the more densely toned areas of a toner image, which are the areas where toner offset may be a particular problem are the areas which receive more overlay toner.

According to a preferred embodiment, a method for creating a multicolor toner image with an overlay toner comprises the following steps. First, a series of five electrostatic images are formed; four of the electrostatic images corresponding to black, cyan, magenta and yellow color information making up a desired final toner image and a fifth electrostatic image corresponding to all the color information of the final toner image. Next, the corresponding electrostatic images are each toned with black, cyan, magenta, yellow and overlay toners. These toner images are superimposed in registration onto a receiver with the overlay toner on top. Then, the toners are fixed by contact with a fuser, which is heated and the receiver is released from the fuser at a temperature at which the overlay toner is non-adhesive to the fuser, but at which at least one of the color toners is adhesive and would offset onto the fuser if the overlay toner were not present.

The process of this invention provides the benefit of allowing for higher fuser release temperatures, and therefore, increased fusing speeds. In a belt fuser, the increased fusing speeds can be obtained by a faster moving belt and/or by shortening the belt, thereby reducing the contact time of the toner-bearing receiver with the fuser belt. In addition, the process of this invention provides several additional advantages over the background art described earlier. Firstly, coating the fuser with silicone oil or similar release agent is no longer required to prevent toner offset; therefore, the contamination of an electrostatographic machine and other problems caused by the application of silicone oil can be avoided. Secondly, release additives do not have to be added to all of the toners, because the overlay toner will prevent all the underlay toners from adhering to the fuser. This simplifies the manufacture of the underlay toners, and improves the adhesion of the underlay toners to the receiver and to each other. Thirdly, as compared to the application of a transparent toner everywhere on a receiver, less overlay toner applied imagewise can be used to prevent toner offset. The less toner that is applied, the less toner that will have to be removed by the cleaning, and the less wear on the machine. Fourthly, the overlay toner can be specially formulated to achieve a desirable imagewise gloss, and to prevent the underlay toner(s) from offsetting and sticking to contacting materials when stacked and stored.

One embodiment of the invention is illustrated in FIG. 1. An original 10, in FIG. 1 (*a*), is a multicolor toner image. An image member 20, for example, a photoconductive element or a dielectric element, is uniformly charged, FIG. 1 (*b*-1), and imagewise exposed to form an electrostatic image 102, FIG. 1 (*c*-1), representative of the black content of original 10. Electrostatic image 102 is developed by the application of a black toner to create a black color toner image 104, FIG. 1 (*d*-1), corresponding to electrostatic image 102. Black toner image 104 is transferred to a receiver 30, FIG. 1 (*e*-1).

This process is repeated for the cyan, magenta and yellow color content of multi-color original 10; uniformly charging the image member 20, forming electrostatic images 202, 302 and 402, and forming color toner images 204, 304 and 404. Cyan is illustrated in FIG. 1 (*b*-2) to (*e*-2), magenta in FIG. 1 (*b*-3) to (*e*-3), and yellow in FIG. 1 (b-4) to (*e*-4). Color toner images 104, 204, 304 and 404 are superimposed in registration with each other onto a receiver 30, FIG. 1 (*e*-1),(*e*-2),(*e*-3),(*e*-4), creating an underlay toner image 106.

Referring now to FIG. 1 (*b*-5) to (*e*-5), image member 20 is again uniformly charged. Electrostatic image 502, FIG. 1 (*c*-5), is created by imagewise exposing image member 20 to the entire colored area of multicolored original 10, that is, the area bearing color information for black, cyan, magenta, and yellow. Electrostatic image 502 is then toned with an overlay toner to create an overlay toner image 504, FIG. 1 (*d*-5). Overlay toner image 504 is transferred to the receiver 30 in registration with underlay toner image 106, creating a composite toner image 108 on receiver 30.

Receiver 30 is then passed through a fuser 39, FIG. 1 (f), which contacts composite toner image 108 and applies pressure and heat to fix composite toner image 108 to the receiver 30.

Fusing is carried out at a temperature and pressure at which no toner offset occurs, although offset would occur if the overlay toner were not applied. The fuser can be any contact fusing system. Examples of fusers include, but are not limited to, belt fusers and roller fusers.

Figure 2:
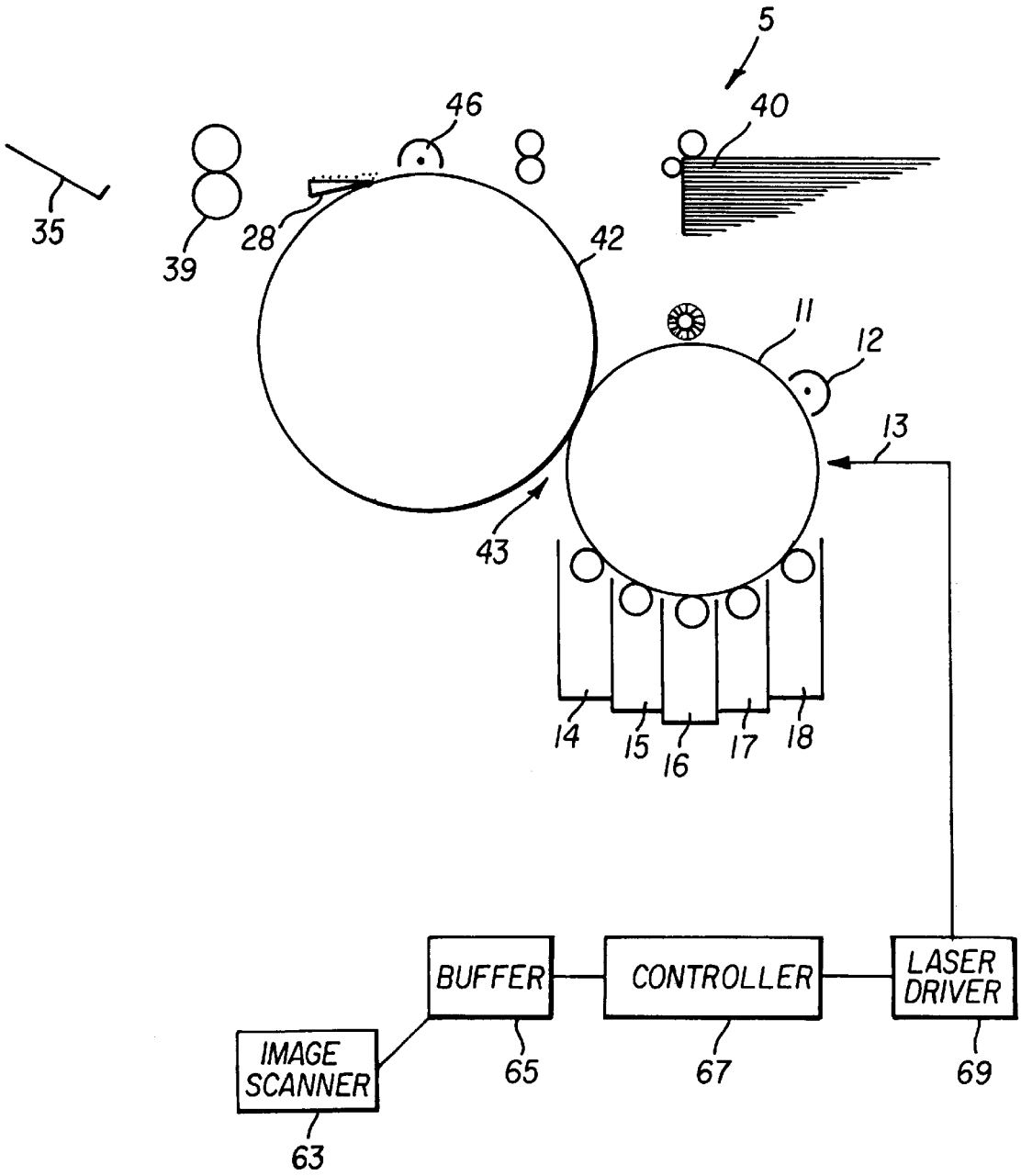
FIG. 2 is a diagrammatical front view of an apparatus for carrying out the method illustrated in FIG. 1.

Referring now to FIG. 2, an image-forming apparatus 5 is shown for carrying out an alternative embodiment of the method of the invention. In the discussion of this embodiment, designations and reference numerals not shown in FIG. 2 refer to equivalents of items in FIG. 1 bearing like reference numerals. An original 10 is scanned by an input scanner 63 into a buffer 65 or other memory. A controller 67 utilizes input from the buffer 65 to provide appropriate bit maps to a driver 69 which controls a laser 13 or other similar exposing device. The controller 67 provides to the laser 13 one bit map for the overlay toner image 504 plus a bit map for each of the color toner images 404, 304, 204 and 104. The controller 67 can be programmed to provide to the laser 13 bit maps for exposing areas of uniform or nonuniform potential for the areas to be toned with the overlay toner.

A photoconductive drum 11 is rotated past a series of electrophotographic stations 12–18. A charging station 12 uniformly charges an image surface (not designated) of drum 11. The uniformly charged image surface is imagewise exposed by the laser 13 to create a series of electrostatic images on drum 11. The process disclosed in FIG. 1 is followed, except that the order of the images formed and developed is reversed, because an intermediate transfer drum 42 is used in the FIG. 2 embodiment. Thus, overlay image 502 is formed first, followed by the yellow image 402, magenta image 302, cyan image 202, and black image 102, in that order. The respective electrostatic images 502, 402, 302, 202 and 102 are toned by individual development stations 14, 15, 16, 17 and 18, respectively, to form toner images 504, 404, 304, 204 and 104.

The individual toner images 504, 404, 304, 204 and 104 are individually transferred in a transfer nip 43, directly to the outside surface of a transfer drum 42, in registration, to create a reverse composite toner image (not designated). The order of individual toner images, extending outward from the drum 42 is overlay toner image 504, yellow toner image 404, magenta toner image 304, cyan toner image 204, then black toner image 104. The transfer drum 42 is an intermediate which accumulates the toner images in registration, which allows for a straight paper path in the system and makes registration of the toner images somewhat easier than in a system in which transfer is made directly from the image surface to the receiver 30.

The reverse composite toner image is transferred from the transfer drum 42 in one step to a receiver 30 (not shown in FIG. 2) to form a composite toner image 108 on the receiver The receiver 30 is fed from a receiver supply 40 to a transfer station 46. The composite toner image on the receiver comprises, from the surface of the receiver out, the black toner image 104, the cyan toner image 204, the magenta toner image 304, the yellow toner image 404, and the overlay toner image 504. The toner-bearing receiver 30 is separated from drum 42 by a pawl or skive 28 and fed through fuser 39 which subjects the receiver 30 and the composite toner image 108 to a combination of pressure and heat which causes the composite toner image 108 to fix to the receiver 30. Again, fusing is carried out at a temperature and pressure at which no toner offset occurs, although offset would occur if the overlay toner were not applied. After releasing from the fuser, the receiver is held in an output hopper 35.

The overlay toner and color toners can comprise toner compositions which are known in the art. For example, various polymers which can be employed in the toners are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554, and fusible crosslinked polymers as described in U.S. Reissue Pat. No. 31,702. Other useful toner polymers include certain polycarbonates such as those described in U.S. Pat. No. 3,694,359, polymeric esters of acrylic and methacrylic acid, such as, poly(alkyl acrylate), and poly (alkyl methacrylate), polyesters and copolyesters prepared from terephthalic acid moieties, bis(hydroxyalkoxy) phenylalkane, and various styrene-containing polymers, such as those containing alkyl moieties and/or vinyl monomers other than styrene, such as, higher alkyl acrylate or methacrylate. Examples of useful styrene-containing toner materials and developer compositions are disclosed in U.S. Pat. Nos. 2,917,460, Re 25,136, 2,788,288, 2,638,416, 2,618,552 and 2,659,670. Especially preferred toner compositions comprise polymers of styrene or a derivative of styrene and acrylate, preferably butylacrylate.

The overlay toners can be formulated in any way known to the art of making toners with improved release properties. For example, the overlay toner can comprise toner polymers with the addition of polymeric binder release additives or low surface energy, low molecular weight additives. To formulate a clear overlay toner, the release additives even in a dispersed phase must match the refractive index of the toner binder to maintain its transparency. These release additives may comprise fatty acids (for example, stearic acid, oleic acid, azelaic acid, and pellargonic acid), fatty alcohols, fatty acid esters (for example, polyvinyl stearate), metathenic soaps of fatty acids (for example, calcium stearate, and barium laurate), metallic complexes of fatty acids (for example, sodium stearate, and potassium oleate), organic compounds of silicon, hydrocarbon waxes, glycols and polyglycols. These and other release additives are known in the art. For example, see U.S. Pat. Nos. 4,758,506 and 4,814,253 for more information on toner release additives. The most preferred additives for this invention are zinc stearate, olefin wax, octadecyl succinic anhydride and stearic acid. The most preferred method to prepare the overlay toners is by adding these additives to a toner binder.

Alternatively, the overlay toner can be made by modifying the polymer structure of a toner by the incorporation of comonomers which lower the surface energy of the toner. For details on making overlay toners with this release formulation, see U.S. Pat. No. 5,089,547, titled, "Cross-linked Low Surface Adhesion Additives For Toner Compositions". For example, the overlay toner may comprise a silicone resin, a polyester cross-linked with a polyfunctional epoxy novolac resin or low surface energy binders such as isobutyl methacrylate, isopropyl methacrylate, heptafluoromethacrylate, and n-butyl methacrylate.

With the addition of release additives or modification of the properties of the toner binders, the release temperatures of the overlay toner binders can be increased by anywhere from a few degrees to one hundred or more degrees. The maximum release temperature of any overlay toner is a function of the characteristics of the overlay toner, for example, surface energy and melt elasticity, and a function of the characteristics of the fuser, for example, the surface energy of the contacting fuser, fuser speed, nip width, and fuser pressure and temperature. Therefore, the exact maximum release temperature for an overlay toner cannot be precisely predicted, but can be predetermined by testing the overlay toner in the fuser in which it is to be used. For example, see Tables 1 and 2 for the maximum release temperatures for various overlay toners tested in the specified roller fuser and belt fuser.

The overlay toners used in the process of this invention can be made by conventional melt compounding and grinding of the charge agent, binder, pigment and appropriate additive for release properties. Further, the overlay toners can be made by suspension polymerization as disclosed in U.S. Pat. Nos. 4,965,131, 4,835,084 and 4,833,060.

The overlay and underlay toners are applied to the electrostatic images by conventional methods, for example, by cascade or magnetic brush development methods.

The following examples illustrate overlay toners that can be used in the invention, and the increased release temperatures from the fuser made possible by the addition of the overlay toner.

COMPARATIVE EXAMPLE A AND EXAMPLES 1 TO 12

Toner images, with and without overlay toner images, were fused in a roller fuser consisting of a red rubber fuser roller and a stainless steel pressure roller to determine the highest release temperatures at which various toner samples could pass through the fuser without toner offset onto the fuser roller. In Comparative Example A and Examples 1 to 12 no silicone oil or other similar release aid was applied to the fuser roller to assist the release. The fuser roller had a red rubber coating of approximately 1.78 millimeters. The pressure at the nip was approximately 280 kPa and the line speed was about 10 cm/sec. The recorded temperatures were measured at the nip, which indicate the fusing and release temperatures for this roller fuser.

The electrostatic image of a solid patch, approximately 15 cm by 15 cm, was created electrophotographically on an organic, multilayer photoconductive image member. The electrostatic image was then developed with at least a monolayer of color toner and was transferred to a paper receiver. The color toner that was used was a crosslinked 77 weight percent styrene butyl acrylate copolymer. Comparative Example A is the control, because no overlay toner was transferred to the receiver over the color toner. In Examples 1 to 12, at least a monolayer of color toner was transferred to a receiver sheet, and at least a monolayer of overlay toner was transferred in registration over the color toner patch on the receiver before the receiver was passed through the roller fuser. Table 1 lists the color toner, overlay toners and the highest release temperatures at which the toner-bearing receiver could be passed through and released from the roller fuser without toner offset to the red rubber fuser roller for each of the examples.

TABLE 1

| Example Number | Color Toner | Overlay Toner | Highest Roller Release Temperature (° F.) |
|---|---|---|---|
| A | crosslinked styrene butyl-acrylate | None | 325 |
| 1 | crosslinked styrene butyl-acrylate | isobutyl methacrylate copolymer | 400 |
| 2 | crosslinked styrene butyl-acrylate | styrene butylacrylate isobutyl methacrylate copolymer (44 weight % styrene, 6 weight % butylacrylate) | 400 |
| 3 | crosslinked styrene butyl-acrylate | methyl methacrylate butyl methacrylate copolymer (33 weight % methyl methacrylate) | 350 |
| 4 | crosslinked styrene butyl-acrylate | isobutyl methacrylate heptafluorometh-acrylate copolymer (90 weight % isobutyl methacrylate) | 350 |
| 5 | crosslinked styrene butyl-acrylate | methyl methacrylate copolymer (Elvacite ™ 2014 by DuPont) | 400 |
| 6 | crosslinked styrene butyl-acrylate | isobutyl methacrylate methyl methacrylate copolymer (90 weight % isobutyl meth-acrylate) | 400 |
| 7 | crosslinked styrene butyl-acrylate | crosslinked styrene butylacrylate copolymer (77 weight % styrene, 33 weight % butylacrylate) with stearamide | 375 |
| 8 | crosslinked styrene butyl-acrylate | crosslinked styrene butylacrylate copolymer (77 weight % styrene) with zinc stearate | 375 |
| 9 | crosslinked styrene butyl-acrylate | crosslinked styrene butylacrylate copolymer (77 weight % styrene) with stearic acid | 375 |
| 10 | crosslinked styrene butyl-acrylate | crosslinked styrene butylacrylate copolymer (77 weight % styrene) with octadecyl succinic anhydride | 375 |
| 11 | crosslinked styrene butyl-acrylate | crosslinked styrene butylacrylate copolymer (77 weight % styrene) with low molecular weight polypropylene (Viscol ™ 660 by Hercules-Sanyo) | 325 |
| 12 | crosslinked styrene butyl-acrylate | crosslinked styrene butylacrylate copolymer (77 weight % styrene) with polydecamethylene sebacate | 350 |

Examples 1 to 12 indicate in all but one case a 25° to 75° F. increase in the fuser roller release temperatures before any visible toner offset. Because the release temperature is approximately the same as the fusing temperature in a roller fuser, this represents an increase in the hot offset temperature of the toners due to the presence of the overlay toners. At increased fusing temperatures, the speed of the fuser roller, and therefore, the speed of the toner images through the fuser can be increased.

COMPARATIVE EXAMPLE B AND EXAMPLES 13 TO 24

Toner images, with and without overlay toner images, were fused by a belt fuser to determine the highest release temperatures at which various toner samples could release from the belt fuser without offsetting onto the belt. In Comparative Examples B and Examples 13 to 24, no oil or other release agent was applied to the belt to assist the release of the toners from the belt. The configuration of the belt fuser is illustrated in U.S. Pat. No. 5,089,363, which is incorporated herein by reference.

The fusing temperature at the nip for all the examples was 260° F. The pressure at the nip was about 690 kPa. The feed rate through the fuser varied between about 3.3 cm/sec to about 13 cm/sec. The fuser belt remained in contact with the toner-bearing receiver for approximately 15 cm to 23 cm until the belt turned around a roller and the beam strength of the receiver caused the receiver to separate from the belt. During the travel time from the nip to where the receiver separated from the belt, the belt cooled from 260° F. at the nip to a release temperature. In most examples a blower was used to cool the belt to the desired release temperature. The recorded temperature is the highest temperature of the belt measured where the receiver released from the belt when no toner offset onto the belt.

Because the toner-bearing receiver releases from the belt in a belt fuser after the belt cools to a lower temperature than the temperature at the nip, it is possible to fuse lower molecular weight toners using a belt fuser than using a roller fuser. Lower molecular weight toners usually offset at lower temperatures than higher molecular weight toners. The lower molecular weight color toner which was used in Comparative Example B as the control and in Examples 13 to 24 as the underlay toner onto which an overlay toner was electrostatically transferred was a styrene butyl acrylate copolymer with 80 weight % styrene, trade name Piccotoner™ 1221 available from Hercules-Sanyo, Inc.

In Comparative Example B and Examples 13 to 24, an electrostatic image of a solid patch, approximately 15 cm by 15 cm, was created electrophotographically on a photoconductive image member, and was developed with at least a monolayer of Piccotoner™ 1221 and transferred to a paper receiver. In Comparative Example B, no overlay toner was applied and the highest temperature of the belt at the release point at which no Piccotoner™ 1221 offset onto the belt was 130° F. For Examples 13 to 24, a monolayer of various overlay toners was electrostatically transferred in registration onto the patch of a monolayer of Piccotoner™ 1221 and the toner-bearing receiver was passed through the belt fuser. The highest release temperature was measured and recorded for each example. Table 2 indicates the color toner, overlay toner and the highest belt release temperature for each of the examples.

TABLE 2

| Example Number | Color Toner | Overlay Toner | Highest Belt Release Temperature (° F.) |
|---|---|---|---|
| B | Piccotoner ™ 1221 | None | 130 |
| 13 | Piccotoner ™ 1221 | Piccotoner ™ 1221 with zinc stearate | 170 |

TABLE 2-continued

| Example Number | Color Toner | Overlay Toner | Highest Belt Release Temperature (° F.) |
|---|---|---|---|
| 14 | Piccotoner ™ 1221 | Piccotoner ™ 1221 with octadecyl succinic anhydride | 170 |
| 15 | Piccotoner ™ 1221 | Piccotoner ™ 1221 with stearamide | 170 |
| 16 | Piccotoner ™ 1221 | Piccotoner ™ 1221 with a low molecular weight polypropylene (Viscol° 660) | >218* |
| 17 | Piccotoner ™ 1221 | Piccotoner ™ 1221 with stearic acid | 195 |
| 18 | Piccotoner ™ 1221 | Isobutyl methacrylate copolymer | 150 |
| 19 | Piccotoner ™ 1221 | Styrene butyl acrylate isobutyl methacrylate copolymer (38 weight % styrene, 12% butyl acrylate) | 150 |
| 20 | Piccotoner ™ 1221 | Isobutyl methacrylate heptofluoromethacrylate copolymer (90 weight % isobutyl methacrylate) | >212* |
| 21 | Piccotoner ™ 1221 | Isobutyl methacrylate methyl acrylate copolymer (90 weight % isobutyl methacrylate) | 150 |
| 22 | Piccotoner ™ 1221 | Methyl methacrylate butyl methacrylate copolymer (33 weight % methyl methacrylate) | 200 |
| 23 | Piccotoner ™ 1221 | Polyvinyl butyral | 143 |
| 24 | Piccotoner ™ 1221 | Methyl methacrylate copolymer (Elvacite ™ 2014 produced by DuPont) | 170 |

*Highest belt release temperature for this equipment, that is, the speed of the belt was at its maximum of 13 cm/sec and the blower was not used during these runs.

Examples 13 to 24 indicate a 13° to 88° F. increase in the release temperatures as a result of the application of the overlay toner. An increase in the release temperature in a belt fuser is an increase in the cold separation temperature, because the release temperature in a belt fuser is lower than the fusing temperature. An increase in the cold offset temperature will allow for increases in the fusing temperature and/or the belt speed, or a decrease in the belt length and therefore an increase in the rate of fusing of the toners to the receiver.

All but one of the examples from the roller fuser, Examples 1 to 12, and belt fuser, Examples 13 to 24, indicate that an overlay toner image, comprising overlay toner, applied over an underlay toner image, comprising underlay toner, will prevent toner from offsetting onto a fuser at higher temperatures than for an underlay toner image alone. The increase in the release temperatures (up to 88° F.) is because of the non-adhesive characteristics of the overlay toners. The increased release temperatures and therefore increased fuser speeds are achieved by applying overlay toner imagewise over the color toner(s) on a receiver.

The invention has been described in detail with particular reference to the preferred embodiments thereof, but it will be understood that variations and modifications can be effected within the spirit and scope of the invention.

What is claimed is:

1. An image forming method in an electrostatographic apparatus having a fuser, comprising the steps of:

forming a composite toner image on a receiver, said composite toner image having an underlay image comprising underlay toner and an overlay image comprising overlay toner, said overlay image being imagewise on top of said underlay image, said underlay toner being adhesive to said fuser at a release temperature, said overlay toner being non-adhesive to said fuser at said release temperature;

fixing said composite toner image on said receiver by contacting said composite toner image on said receiver with said fuser; and releasing said composite toner image on said receiver from said fuser at said release temperature whereby the release temperature of the fuser is higher than if said overlay toner were not on top of said underlay toner.

2. The method according to claim 1, wherein said forming step, said overlay toner image further comprises overlay toner of uniform density.

3. The method according to claim 1, wherein said forming step, said overlay toner image further comprises overlay toner of nonuniform density, said nonuniform density being proportional to the density of said underlay toner.

4. The method according to claim 1, wherein the fixing step includes feeding said composite toner image on said receiver through a nip formed by a pair of rollers, at least one of which is heated.

5. The method according to claim 1, wherein the fixing step includes feeding said composite toner image on said receiver through a nip formed by a belt and a pressure roller, at least one of which is heated.

6. An image forming method in an electrostatographic apparatus which provides for increased release temperatures of a composite toner image on a receiver from a fuser, comprising the steps of:

forming at least one color image comprising at least one color toner and an imagewise overlay image comprising an overlay toner, at least one of said color toners being adhesive to said fuser at a release temperature, said overlay toner being non-adhesive to said fuser at said release temperature;

transferring at least one said color image and overlay image, in registration, to a receiver with said overlay image on top to form a composite toner image;

fixing said composite toner image to said receiver by contacting said composite toner image on said receiver with said fuser; and releasing said composite toner image on said receiver from said fuser at said release temperature whereby the offset of said overlay toner and said color toner onto said fuser is prevented by the presence of said overlay toner.

7. The method according to claim 6, wherein said forming step, said overlay toner image further comprises overlay toner of uniform density.

8. The method according to claim 6, wherein said forming step, said overlay toner image further comprises overlay toner of nonuniform density, said nonuniform density being proportional to the density of said color toner in said composite toner image.

9. The method according to claim 6, wherein said transferring step further comprises the steps of transferring said overlay toner image and said color toner image, in registration, to an intermediate transfer roller to form a reverse composite toner image, said reverse composite toner image comprising said overlay toner image under said color toner image and then transferring said reverse composite toner image from said intermediate transfer roller to a receiver to form a composite toner image on said receiver with said overlay toner image on top.

10. The method according to claim 6, wherein the fixing step includes feeding said composite toner image on said receiver through a nip formed by a pair of rollers, at least one of which is heated.

11. The method according to claim 6, wherein the fixing step includes feeding said composite toner image on said receiver into a pressure nip formed by a belt and a pressure roller, at least one of which is heated.

12. An image forming method in an electrostatographic apparatus having a fuser, comprising the steps of:

forming a series of electrostatic images, each of said electrostatic images corresponding to one color in a desired multicolor final image and an additional electrostatic image corresponding to all of the colors in said desired multicolor final image;

applying color toners to said electrostatic images to form color images, at least one of said color toners being adhesive to said fuser at a release temperature;

applying an overlay toner to said electrostatic image corresponding to all of the colors in said desired multicolor final image to form an overlay image, said overlay toner being non-adhesive to said fuser at said release temperature;

superimposing said color images and said overlay image, in registration, onto a receiver to form a composite toner image with said color images under said overlay image;

fixing said composite toner image to said receiver by contacting said composite toner image on said receiver with said fuser; and releasing said composite toner image on said receiver from said fuser at said release temperature to form said desired multicolor final image with said overlay toner image on top of said color toner images whereby no release agents are present on said fuser to prevent offset of said overlay toner and said color toners.

13. The method according to claim 12, wherein the fixing step includes feeding said composite toner image on said receiver through a nip formed by a pair of rollers, at least one of which is heated.

14. The method according to claim 12, wherein the fixing step includes feeding said composite toner image on said receiver into a pressure nip formed by a belt and a pressure roller, at least one of which is heated.

15. The method according to claim 12, wherein said forming step further comprises forming five electrostatic images; four of said electrostatic images corresponding to the black, cyan, magenta, and yellow color information making up said desired multicolor final toner image and the fifth electrostatic image, being said additional electrostatic image corresponding to all of the colors in said desired multicolor final toner image.

16. The method according to claim 15, wherein said forming step includes forming said fifth electrostatic image with areas of uniform potential corresponding to the areas to receive said color toners in said desired multicolor final toner image.

17. The method according to claim 15, wherein said forming step includes forming said fifth electrostatic image with areas of nonuniform potential, said areas being proportional to the density of said color toners in said desired multicolor final toner image.

18. The method according to claim 15, wherein said superimposing step further comprises the steps of transferring said overlay toner image and said color toner images, in registration, to an intermediate transfer roller to form a reverse composite toner image, said reverse composite toner image comprising said overlay toner image under said color toner images and then transferring said reverse composite toner image from said intermediate transfer roller to a receiver to form a composite toner image on said receiver with said overlay toner image on top.

19. The method according to claim 15, wherein said forming step is preceded by the step of electronically analyzing an original image to determine the areas of black, cyan, magenta, yellow and overlay toner in said desired multicolor final toner image.

20. The method according to claim 15, wherein said overlay toner is a clear toner.

* * * * *